US010631600B2

(12) United States Patent
Moyo

(10) Patent No.: US 10,631,600 B2
(45) Date of Patent: Apr. 28, 2020

(54) ILLUMINATED SAFETY CANE

(71) Applicant: Kurai Moyo, Boston, MA (US)

(72) Inventor: Kurai Moyo, Boston, MA (US)

( * ) Notice: Subject to any disclaimer, the term of this patent is extended or adjusted under 35 U.S.C. 154(b) by 0 days.

(21) Appl. No.: 16/133,745

(22) Filed: Sep. 18, 2018

(65) Prior Publication Data

US 2020/0085157 A1 Mar. 19, 2020

(51) Int. Cl.
*A45B 3/04* (2006.01)
*A45B 9/02* (2006.01)

(52) U.S. Cl.
CPC . *A45B 3/04* (2013.01); *A45B 9/02* (2013.01)

(58) Field of Classification Search
CPC ..... A45B 3/04; A45B 9/02
See application file for complete search history.

(56) References Cited

U.S. PATENT DOCUMENTS 4,583,080 A 4/1986 DeVito
D338,553 S 8/1993 Flemming
5,331,990 A * 7/1994 Hall ..... A45B 3/00 135/65
6,711,772 B2 3/2004 Grassi
7,654,275 B2 2/2010 Ewell
8,517,555 B1 8/2013 LeJeune
8,985,802 B2 * 3/2015 Nievas ..... A45B 3/04 135/75
9,131,753 B2 * 9/2015 Chien ..... A45B 9/02
9,528,692 B2 12/2016 Kohn
2008/0251109 A1 * 10/2008 Lee ..... A45B 3/00 135/66
2009/0223546 A1 * 9/2009 Nazarian ..... A45B 3/04 135/66
2013/0014790 A1 * 1/2013 Van Gerpen ..... A61H 3/04 135/66
2015/0070877 A1 * 3/2015 Smith ..... A45B 3/02 362/102
2018/0084877 A1 * 3/2018 Sarauer ..... A45B 3/02

* cited by examiner

*Primary Examiner* — Mary Ellen Bowman

(57) ABSTRACT

The illuminated safety cane is a walking cane comprising a handle and a shaft. The shaft is a rigid cylinder with a plurality of apertures covered by a plurality of windows through which a plurality of lights may provide illumination. The plurality of lights may be white, yellow, or red LEDs mounted onto one or more circuit boards located within the shaft. The white lights may provide illumination, the yellow lights may provide cautionary warnings, and the red light may indicate danger or distress. The lights may be illuminated individually or in groups through user activation of an operator control located on the handle. The handle provides a grasping point for the cane and encloses one or more batteries, the operator control, and an audible panic alarm.

11 Claims, 4 Drawing Sheets

ILLUMINATED SAFETY CANE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of walking canes, more specifically, an illuminated safety cane.

SUMMARY OF INVENTION

The illuminated safety cane is a walking cane comprising a handle and a shaft. The shaft is a rigid cylinder with a plurality of apertures covered by a plurality of windows through which a plurality of lights may provide illumination. The plurality of lights may be white, yellow, or red LEDs mounted onto one or more circuit boards located within the shaft. The white lights may provide illumination, the yellow lights may provide cautionary warnings, and the red light may indicate danger or distress. The lights may be illuminated individually or in groups through user activation of an operator control located on the handle. The handle provides a grasping point for the cane and encloses one or more batteries, the operator control, and an audible panic alarm.

An object of the invention is to provide a walking cane for support and stability of a user.

Another object of the invention is to provide white light from within the cane to illuminate the area surrounding the cane.

A further object of the invention is to provide constant or blinking yellow light from within the cane to provide a cautionary warning of the presence of the user.

Yet another object of the invention is to provide contact or blinking red light from within the cane to indicate distress or danger.

These together with additional objects, features and advantages of the illuminated safety cane will be readily apparent to those of ordinary skill in the art upon reading the following detailed description of the presently preferred, but nonetheless illustrative, embodiments when taken in conjunction with the accompanying drawings.

In this respect, before explaining the current embodiments of the illuminated safety cane in detail, it is to be understood that the illuminated safety cane is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the illuminated safety cane.

It is therefore important that the claims be regarded as including such equivalent construction insofar as they do not depart from the spirit and scope of the illuminated safety cane. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
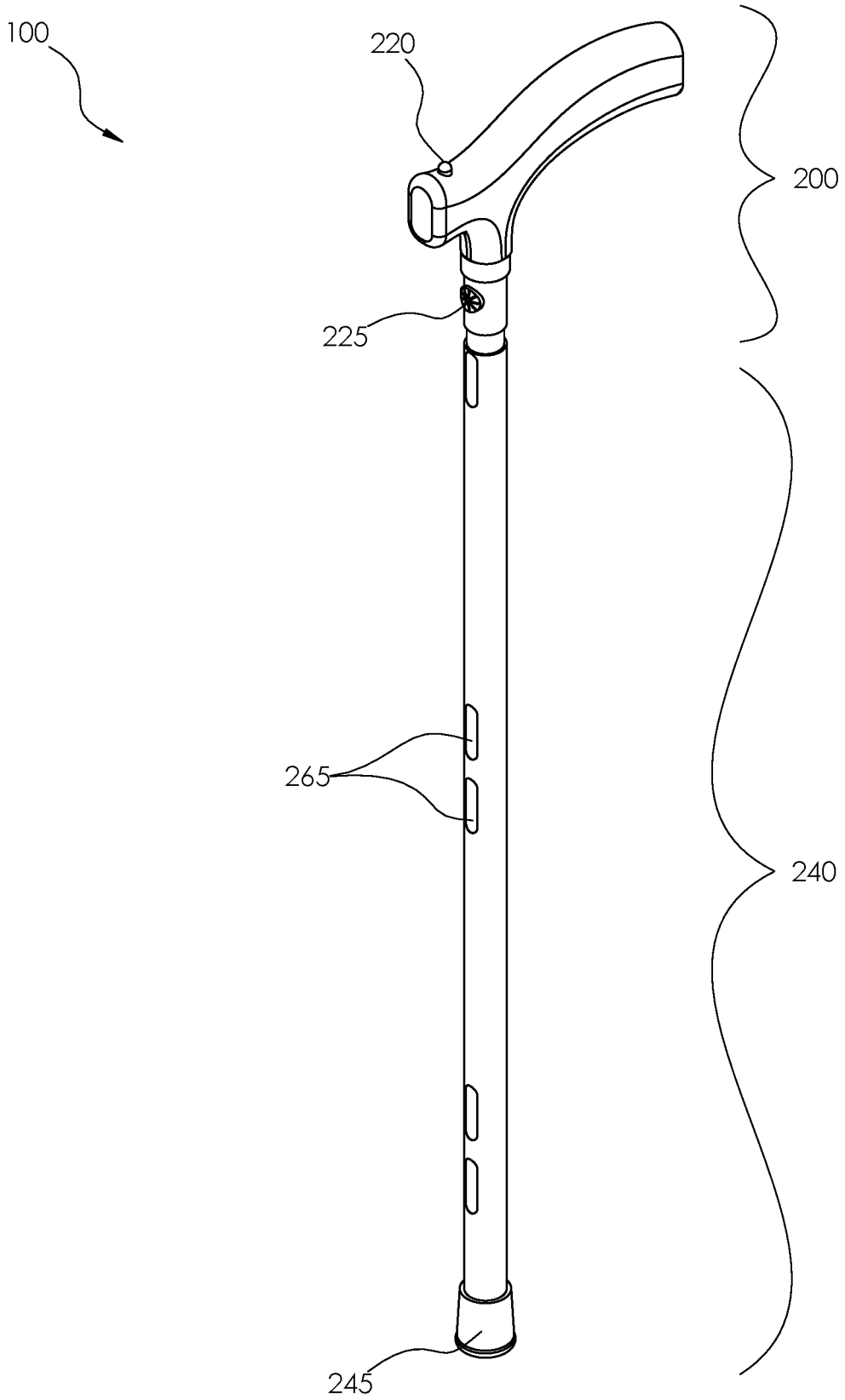
FIG. 1 is a perspective view of an embodiment of the disclosure.
Figure 2:
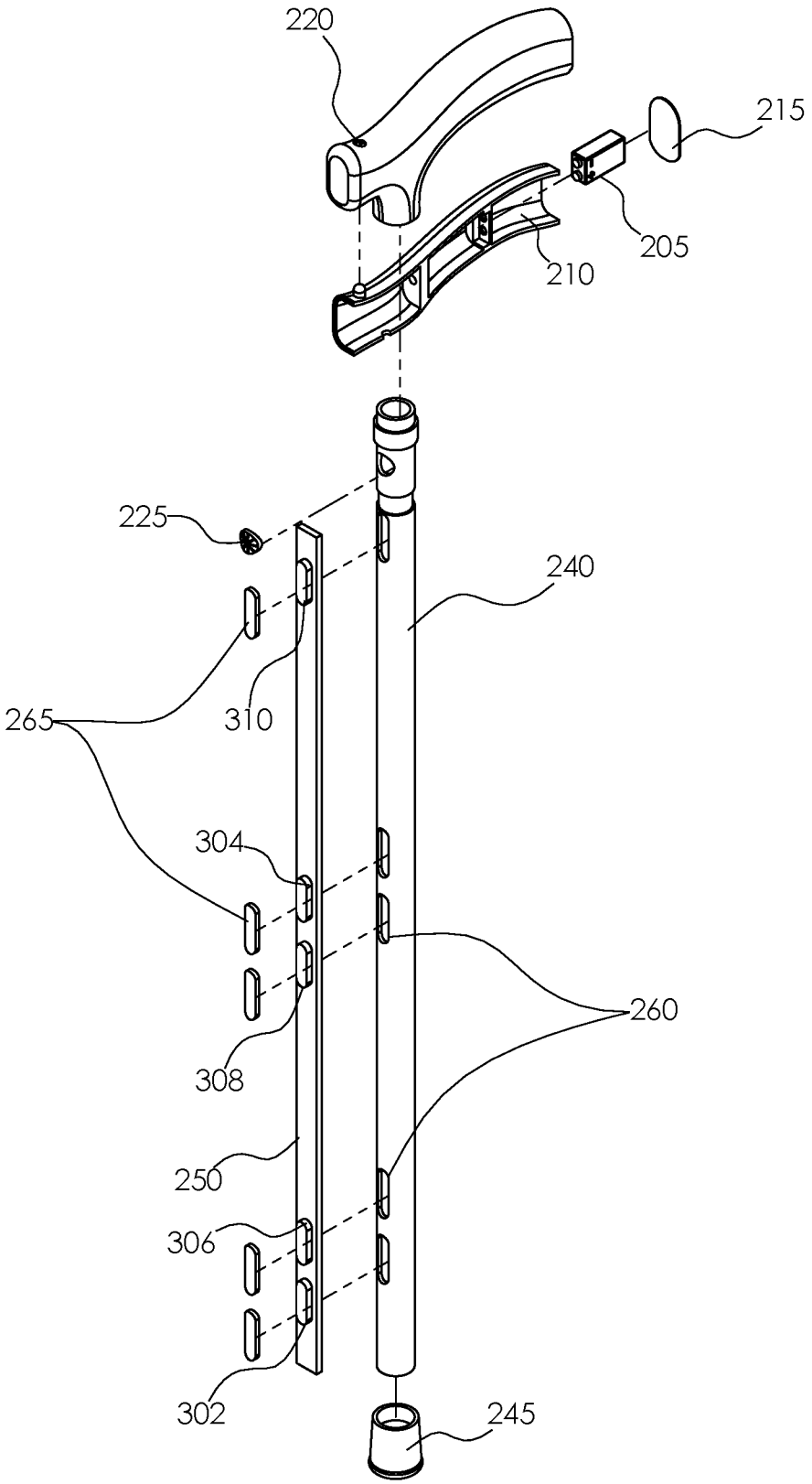
FIG. 2 is an exploded view of an embodiment of the disclosure.
Figure 3:
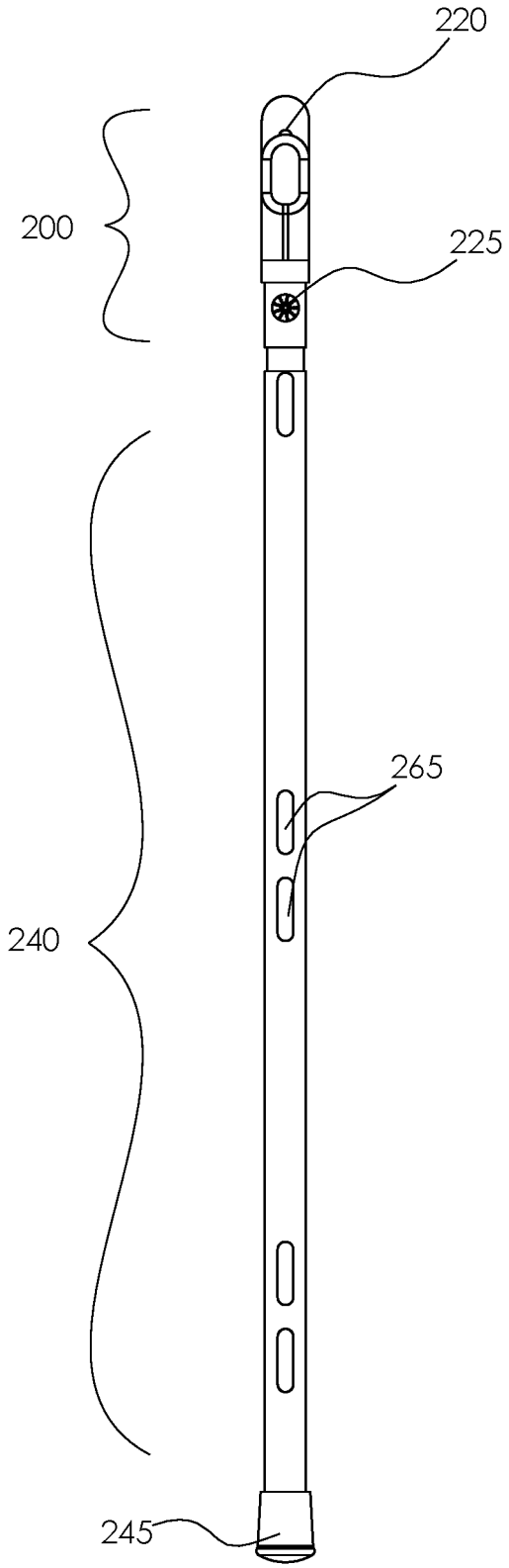
FIG. 3 is a front view of an embodiment of the disclosure.
Figure 4:
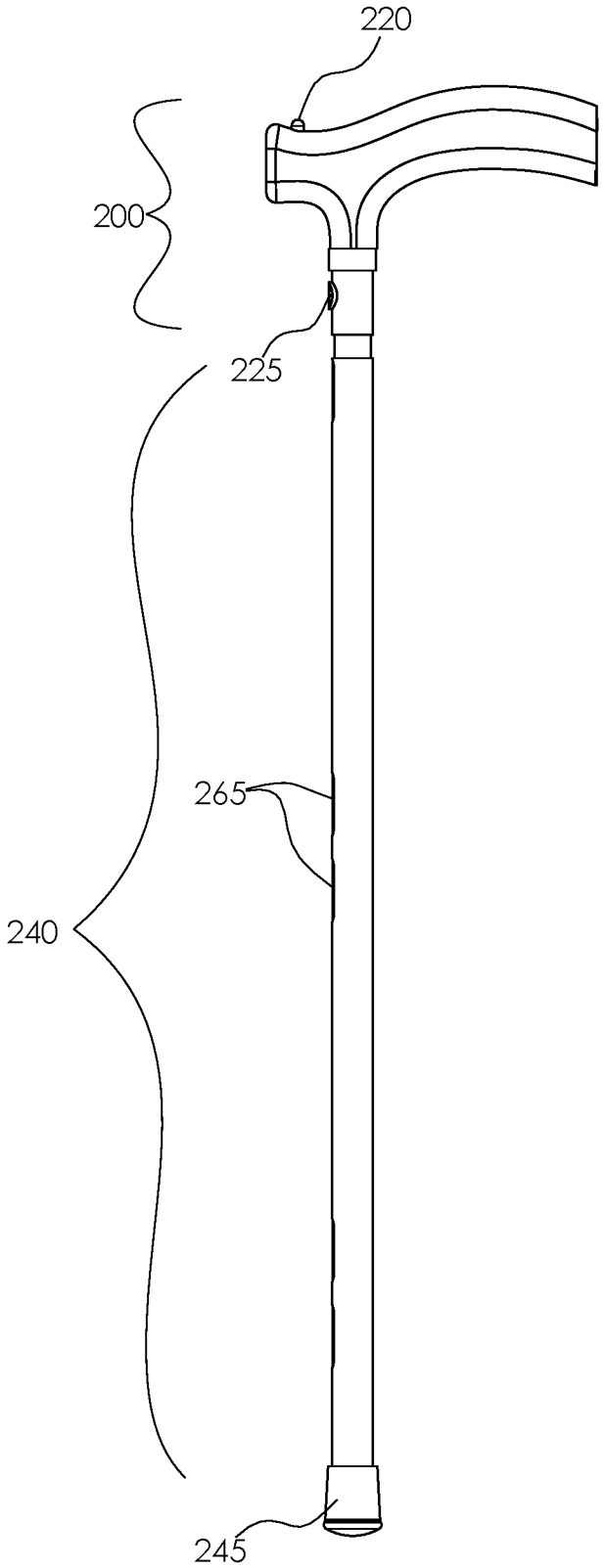
FIG. 4 is a side view of an embodiment of the disclosure.
Figure 5:
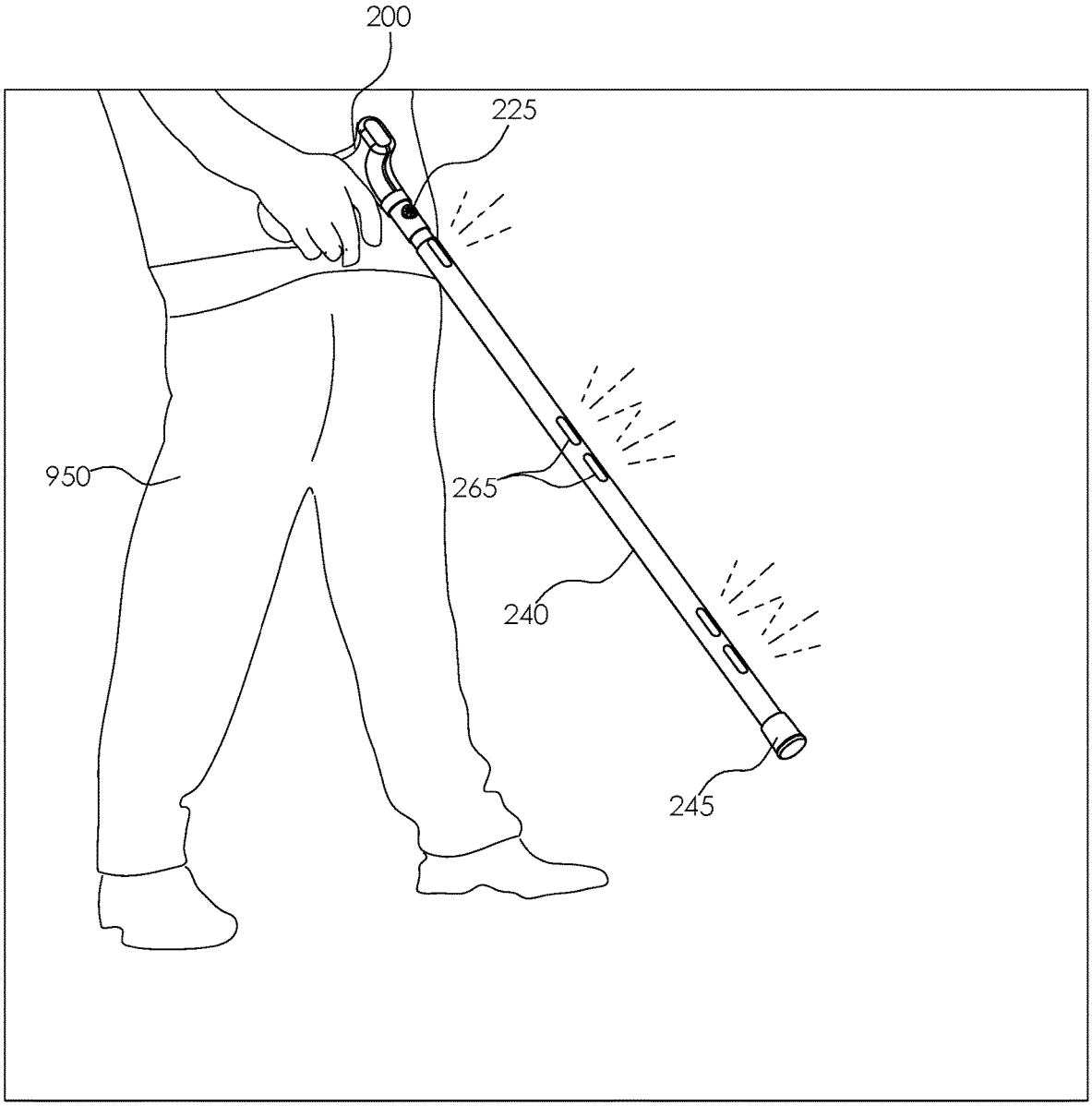
FIG. 5 is an in-use view of an embodiment of the disclosure.

Detailed reference will now be made to a first potential embodiment of the disclosure, which is illustrated in FIGS. 1 through 5.

The illuminated safety cane 100 (hereinafter invention) comprises a handle 200 and a shaft 240. The invention 100 is a walking cane that provides a plurality of illumination sources for visibility and signaling along with a panic alarm 225 for personal safety. The plurality of illumination sources and the panic alarm 225 may be activated using a user control 220 located in the handle 200.

The handle 200 comprises the user control 220, the panic alarm 225, a battery compartment 210, and a battery door 215. The handle 200 may be an enclosure for one or more batteries 205, the panic alarm 225, and the user control 220 and may also be a grasping point for holding the invention 100.

The user control 220 may determine the operational state of the plurality of illumination sources and the panic alarm 225. As a non-limiting example, the user control 220 may be a pushbutton switch where each subsequent depression of the user control 220 may advance the invention 100 to the next step in a cycle of illumination. By way of example and not of limitation, a first depression of the user control 220 may advance the invention 100 from a state of no illumination to a state where a first white light 302 may be on. A subsequent depression of the user control 220 may advance the invention 100 to a state where the first white light 302 and a second white light 304 are both on. A subsequent depression of the user control 220 may advance the invention 100 to a state where the first white light 302 and the second white light 304 are off and a first yellow light 306 and a second yellow light 308 are flashing. This may continue, passing through additional states that activate combinations of the plurality of illumination sources with a plurality of color, intensity, and flashing options, until eventually returning to the initial state where all illumination if off.

The user control 220 may also activate panic mode. As a non-limiting example, panic mode may be activated if the user control 220 is pressed and held for a time period longer than a panic timeout. When panic mode is activated, the invention 100 may energize a red light 310 and the panic alarm 225. The invention 100 may continue to energize the red light 310 and the panic alarm 225 until panic mode is deactivated. As a non-limiting example, panic mode may be deactivated by depressing the user control 220 while panic mode is activated.

The panic alarm 225 may be a sound transducer. The panic alarm 225 may emit a solid or pulsating tone, noise, or sound when energized. The panic alarm 225 is intended to scare off an attacker, alert others of a situation, provide a directional reference, or a combination thereof. In some embodiments, the panic alarm 225 may produce a sound pressure level of 75 dB or more. At 75 dB to 85 dB, the sound pressure level of the panic alarm 225 may be comparable to the sound pressure level of a smoke detector.

The battery compartment 210 may be a cavity that houses the one or more batteries 205. The battery compartment 210 may be located within the handle 200. The battery compartment 210 may comprise the battery door 215 for accessing to the one or more batteries 205.

The shaft 240 comprises a plurality of apertures 260, a plurality of transparent windows 265, one or more circuit boards 250, and a tip 245. The shaft 240 may be a hollow cylinder made from a rigid material. As a non-limiting example, the shaft 240 may be made from aluminum.

The plurality of apertures 260 may be openings on the shaft 240 to provide visibility to the plurality of illumination sources. The plurality of apertures 260 may be spaced such that two of the plurality of apertures 260 are located on the bottom ⅓ of the shaft 240, two of the plurality of apertures 260 are located on the middle ⅓ of the shaft 240, and one of the plurality of apertures 260 is located on the top ⅓ of the shaft 240. In some embodiments, the plurality of apertures 260 may all be located on the front side of the shaft 240.

The plurality of transparent windows 265 may be transparent coverings for the plurality of apertures 260. The plurality of transparent windows 265 may be coupled to the shaft 240 to fill the plurality of apertures 260 and thus protect the plurality of illumination sources from inclement weather. As a non-limiting example, the plurality of transparent windows 265 may be made from clear plastic.

The one or more circuit boards 250 comprises the plurality of illumination sources. The one or more circuit boards 250 may mount within the hollow interior of the shaft 240 such that the plurality of illumination sources coupled to the one or more circuit boards 250 align with the plurality of apertures 260. The one or more circuit boards 250 may be electrically coupled to each other and to the one or more batteries 205 via the user control 220.

The plurality of illumination sources comprises the first white light 302, the second white light 304, the first yellow light 306, the second yellow light 308, and the red light 310. The plurality of illumination sources may be illuminated to increase visibility, provide a warning, request assistance, or combinations thereof.

The first white light 302 may be located behind one of the plurality of transparent windows 265 on the lower ⅓ of the shaft 240. The second white light 304 may be located behind one of the plurality of transparent windows 265 on the middle ⅓ of the shaft 240. The first white light 302 and the second white light 304 may be energized at one or more intensities to provide a plurality of brightness levels. The first white light 302 and the second white light 304 may be energized to provide illumination for one or more areas adjacent to the invention 100.

The first yellow light 306 may be located behind one of the plurality of transparent windows 265 on the lower ⅓ of the shaft 240. The second yellow light 308 may be located behind one of the plurality of transparent windows 265 on the middle ⅓ of the shaft 240. The first yellow light 306 and the second yellow light 308 may blink, remain on solid, or combinations thereof. The first yellow light 306 and the second yellow light 308 may be energized to provide a cautionary warning signal. As a non-limiting example, the first yellow light 306 and the second yellow light 308 may alert vehicles to the presence of a user 950.

The red light 310 may be located behind one of the plurality of transparent windows 265 on the upper ⅓ of the shaft 240. The red light 310 may blink, remain on solid, or combinations thereof. The red light 310 may be energized to request assistance, to provide an alert, or both.

The tip 245 may be a rubberized, non-skid covering for the bottom of the shaft 240.

The one or more batteries 205 may comprise one or more energy-storage devices. The one or more batteries 205 may be a source of electrical energy to operate the plurality of illumination sources and the panic alarm 225. The one or more batteries 205 may be replaceable or rechargeable.

In use, the one or more batteries 205 are installed in the battery compartment 210 through an opening revealed by the battery door 215. The users 950 may walk with the invention 100 and may use the invention 100 for balance and support. In the dark, the user 950 may depress the user control 220 to illuminate the first white light 302 and the second white light to illuminate the surrounding area. In some embodiments, multiple depressions of the user control 220 may allow the user 950 to select the intensity of the illumination. If the user 950 is concerned about traffic, the user 950 may depress the user control 220 until the first yellow light 306 and the second yellow light 308 are illuminated. In some embodiments, the first yellow light 306 and the second yellow light 308 may blink when illuminated. If the user 950 feels threatened, has become lost, and has encountered another situation that the user 950 feels has reached a critical level, the user 950 may use the user control 220 to activate panic mode.

As a non-limiting example, the user 950 may press and hold the user control 220 to activate panic mode. In panic mode, the invention 100 may flash the red light 310 and may emit a high volume sound from the panic alarm 225. The invention 100 may remain in panic mode until panic mode is deactivated by the user 950. As a non-limiting example, the user 950 may deactivate panic mode by depressing the user control 220.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used herein, "align" refers to the placement of two or more components into positions and orientations which either arranges the components along a straight line or within the same plane or which will allow the next step of assembly to proceed. As a non-limiting example, the next step of assembly may be to insert one component into another component, requiring alignment of the components.

As used in this disclosure, an "aperture" is an opening in a surface. Aperture may be synonymous with hole, slit, crack, gap, slot, or opening.

Throughout this document the terms "battery", "battery pack", and "batteries" may be used interchangeably to refer to one or more wet or dry cells or batteries of cells in which chemical energy is converted into electricity and used as a source of DC power. References to recharging or replacing batteries may refer to recharging or replacing individual cells, individual batteries of cells, or a package of multiple battery cells as is appropriate for any given battery technology that may be used. The battery may require electrical contacts, which may not be illustrated in the figures.

As used in this disclosure, a "cavity" is an empty space or negative space that is formed within an object.

As used herein, the words "control" or "controls" are intended to include any device which can cause the completion or interruption of an electrical circuit; non-limiting examples of controls include toggle switches, rocker switches, push button switches, rotary switches, electromechanical relays, solid state relays, touch sensitive interfaces and combinations thereof whether they are normally open, normally closed, momentary contact, latching contact, single pole, multi-pole, single throw, or multi-throw.

As used herein, the words "couple", "couples", "coupled" or "coupling", refer to connecting, either directly or indirectly, and does not necessarily imply a mechanical connection.

As used in this disclosure, a "cylinder" is a geometric structure defined by two identical flat and parallel ends, also commonly referred to as bases, which are circular in shape and connected with a single curved surface which may be referred to as the face. The axis of the cylinder is formed by the straight line that connects the center of each of the two identical flat and parallel ends of the cylinder. Unless otherwise stated within this disclosure, the term cylinder specifically indicates a right cylinder which is defined as a cylinder wherein the curved surface perpendicularly intersects with the two identical flat and parallel ends.

As used in this disclosure, a "door" is a movable or removable barrier that is attached to the wall of a room or the surface of a container for the purpose of allowing or preventing access through an aperture into the room or container.

As used herein, "energize" refers to the application of an electrical potential to a system or subsystem.

As used herein, "front" indicates the side of an object that is closest to a forward direction of travel under normal use of the object or the side or part of an object that normally presents itself to view or that is normally used first. "Rear" or "back' refers to the side that is opposite the front.

As used in this disclosure, a "handle" is an object by which a tool, object, or door is held or manipulated with the hand.

As used in this disclosure, the word "interior" is used as a relational term that implies that an object is located or contained within the boundary of a structure or a space.

As used in this disclosure, a "light" is an electrical device that generates visible light to illuminate objects so they can be seen.

As used in this disclosure, the term "shaft" is used to describe a rigid cylinder that is often used as the handle of a tool or implement or as the center of rotating machinery or motors. The definition of shaft explicitly includes solid shafts or shafts that comprise a hollow passage through the shaft along the center axis of the shaft cylinder, whether the shaft has one or more sealed ends or not.

As used in this disclosure, a "switch" is an electrical device that starts and stops the flow of electricity through an electric circuit by completing or interrupting an electric circuit. The act of completing or interrupting the electrical circuit may be called actuation. Completing or interrupting an electric circuit with a switch is often referred to as closing or opening a switch, respectively. Completing or interrupting an electric circuit is also referred to as making or breaking the circuit, respectively.

As used in this disclosure, a "transducer" is a device that converts a physical quantity, such as pressure or brightness into an electrical signal or a device that converts an electrical signal into a physical quantity.

As used in this disclosure, "transparent" refers to a material that allows light to pass through the material without significant scattering such that an object can be clearly seen through the material.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A illuminated safety cane comprising:

a handle and a shaft;

wherein the illuminated safety cane is a walking cane that provides a plurality of illumination sources for visibility and signaling along with a panic alarm for personal safety;

wherein the plurality of illumination sources and the panic alarm are activated using a user control located in the handle;

wherein the handle comprises the user control, the panic alarm, a battery compartment, and a battery door;

wherein the handle is an enclosure for one or more batteries, the panic alarm, and the user control;

wherein the handle is a grasping point for holding the illuminated safety cane;

wherein the user control determines the operational state of the plurality of illumination sources and the panic alarm;

wherein the user control is a pushbutton switch where each subsequent depression of the user control advances the illuminated safety cane to the next step in a cycle of illumination;

wherein the user control activates the panic alarm;

wherein a first depression of the user control advances the illuminated safety cane from a state of no illumination to a state where a first white light is on;

wherein a subsequent depression of the user control advances the illuminated safety cane to a state where the first white light and a second white light are both on;

wherein a subsequent depression of the user control advances the illuminated safety cane to a state where the first white light and the second white light are off and a first yellow light and a second yellow light are flashing;

wherein panic mode is activated if the user control is pressed and held for a time period longer than a panic timeout;

wherein when panic mode is activated, the illuminated safety cane energizes a red light and the panic alarm;

wherein the illuminated safety cane continues to energize the red light and the panic alarm until panic mode is deactivated;

wherein panic mode is deactivated by depressing the user control while panic mode is activated;

wherein the panic alarm is a sound transducer;

wherein the panic alarm emits a solid or pulsating tone, noise, or sound when energized;

wherein the panic alarm is intended to scare off an attacker, alert others of a situation, provide a directional reference, or a combination thereof;

wherein the battery compartment is a cavity that houses the one or more batteries;

wherein the battery compartment is located within the handle;

wherein the battery compartment comprises the battery door for accessing to the one or more batteries;

wherein the shaft comprises a plurality of apertures, a plurality of transparent windows, one or more circuit boards, and a tip;

wherein the shaft is a hollow cylinder.

2. The illuminated safety cane according to claim 1 wherein the plurality of apertures are openings on the shaft to provide visibility to the plurality of illumination sources;

wherein the plurality of apertures are spaced such that two of the plurality of apertures are located on the bottom ⅓ of the shaft, two of the plurality of apertures are located on the middle ⅓ of the shaft, and one of the plurality of apertures is located on the top ⅓ of the shaft.

3. The illuminated safety cane according to claim 2 wherein the plurality of apertures are all located on the front side of the shaft.

4. The illuminated safety cane according to claim 2 wherein the plurality of transparent windows are transparent coverings for the plurality of apertures;

wherein the plurality of transparent windows are coupled to the shaft to fill the plurality of apertures and thus protect the plurality of illumination sources from inclement weather.

5. The illuminated safety cane according to claim 4 wherein the plurality of transparent windows are made from clear plastic.

6. The illuminated safety cane according to claim 4 wherein the one or more circuit boards comprises the plurality of illumination sources;

wherein the one or more circuit boards mount within the hollow interior of the shaft such that the plurality of illumination sources coupled to the one or more circuit boards align with the plurality of apertures;

wherein the one or more circuit boards are electrically coupled to each other and to the one or more batteries via the user control.

7. The illuminated safety cane according to claim 6 wherein the plurality of illumination sources comprises the first white light, the second white light, the first yellow light, the second yellow light, and the red light;

wherein the plurality of illumination sources are illuminated to increase visibility, provide a warning, request assistance, or combinations thereof.

8. The illuminated safety cane according to claim 7 wherein the first white light is located behind one of the plurality of transparent windows on the lower ⅓ of the shaft;

wherein the second white light is located behind one of the plurality of transparent windows on the middle ⅓ of the shaft;

wherein the first white light and the second white light are energized at one or more intensities to provide a plurality of brightness levels;

wherein the first white light and the second white light are energized to provide illumination for one or more areas adjacent to the illuminated safety cane.

9. The illuminated safety cane according to claim 8 wherein the first yellow light is located behind one of the plurality of transparent windows on the lower ⅓ of the shaft;

wherein the second yellow light is located behind one of the plurality of transparent windows on the middle ⅓ of the shaft;

wherein the first yellow light and the second yellow light blink, remain on solid, or combinations thereof;

wherein the first yellow light and the second yellow light are energized to provide a cautionary warning signal.

10. The illuminated safety cane according to claim 9 wherein the red light is located behind one of the plurality of transparent windows on the upper ⅓ of the shaft;

wherein the red light blinks, remains on solid, or combinations thereof;

wherein the red light is energized to request assistance, to provide an alert, or both.

11. The illuminated safety cane according to claim 10 wherein the one or more batteries comprise one or more energy-storage devices;

wherein the one or more batteries are a source of electrical energy to operate the plurality of illumination sources and the panic alarm;

wherein the one or more batteries are replaceable or rechargeable.

* * * * *